US007900698B2

(12) United States Patent
Stoesz

(10) Patent No.: US 7,900,698 B2
(45) Date of Patent: Mar. 8, 2011

(54) DOWNHOLE WET-MATE CONNECTOR DEBRIS EXCLUSION SYSTEM

(75) Inventor: Carl W. Stoesz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 26 days.

(21) Appl. No.: 11/891,759

(22) Filed: Aug. 13, 2007

(65) Prior Publication Data

US 2009/0045146 A1 Feb. 19, 2009

(51) Int. Cl.
*E21B 17/00* (2006.01)

(52) U.S. Cl. ..... 166/242.6; 166/242.1

(58) Field of Classification Search ..... 166/242.6, 166/242.1, 117.7, 65.1; 439/66, 139, 195; 210/470, 767

See application file for complete search history.

(56) References Cited

U.S. PATENT DOCUMENTS

| | | | | |
|---|---|---|---|---|
| 4,606,603 | A | 8/1986 | Cairns | |
| 4,708,821 | A * | 11/1987 | Shimokawa et al. | 512/12 |
| 4,795,359 | A | 1/1989 | Alcock et al. | |
| 4,948,377 | A | 8/1990 | Cairns | |
| 4,997,384 | A * | 3/1991 | Godfrey et al. | 439/190 |
| 5,838,857 | A | 11/1998 | Niekrasz | |
| 7,252,437 | B2 * | 8/2007 | Ringgenberg | 385/53 |
| 7,344,316 | B2 * | 3/2008 | McKinnon | 385/56 |
| 2002/0070032 | A1 * | 6/2002 | Maguire et al. | 166/381 |
| 2003/0085038 | A1 * | 5/2003 | Restarick et al. | 166/278 |
| 2003/0211768 | A1 * | 11/2003 | Cameron et al. | 439/191 |
| 2005/0072564 | A1 * | 4/2005 | Grigsby et al. | 166/65.1 |
| 2007/0144746 | A1 * | 6/2007 | Jonas | 166/380 |
| 2008/0202766 | A1 * | 8/2008 | Howell et al. | 166/381 |

OTHER PUBLICATIONS

Wright, Perry, et al.; "The Development and Application of HT/HP Fiber-Optic Connectors for Use on Subsea Intelligent Wells"; OTC15323; 2003 Offshore Technology Conference; Houston, TX; May 5-8, 2003; 8 Pgs.

Cairns, James Dr.; "Hybrid Wet-Mate Connectors: Writing The Next Chapter"; Sea Technology; Jul. 1997; 4 Pgs.

Painter, Howard, et al.; "Subsea to Shore- Challenges and Solutions for Subsea Connections"; Brazilian Institute of Petroleum and Gas; IBP1773_06; 2006 Rio Oil & Gas Expo and Conference; Rio De Janiero; Sep. 11-14, 2006; 7 Pgs.

Barlow, Stewart, et al.; The Evolution of ROV Wet-Mate Connector Technology in Supplying High Bandwidth/ High Power/ Deep Water Solutions for the Scientific Ocean Observatory Market; SCC'06—Scientific Submarine Cable 2006, Dublin Castle, Ireland Feb. 8-10, 2006; 7 Pages.

International Search Report and Written Opinion, Mail Date Feb. 11, 2009, Written Opinion 7 Pages, Search Report 3 Pages.

* cited by examiner

*Primary Examiner* — Kenneth Thompson
*Assistant Examiner* — James G Sayre
(74) *Attorney, Agent, or Firm* — Cantor Colburn LLP

(57) ABSTRACT

A downhole wet-connector and debris exclusion system includes a relatively stationary component; a relatively mobile component operably engageable with the relatively stationary component; at least one connector disposed behind a moveable debris exclusion member in a protected condition within the relatively mobile component; and at least one complementary connector disposed behind another movable debris exclusion member in a protected condition within the relatively stationary component each of the moveable debris exclusion members being openable to expose the at least one connectors therebehind upon axial motion of the relatively stationary component and the relatively mobile component into contact with one another and method.

30 Claims, 10 Drawing Sheets

DOWNHOLE WET-MATE CONNECTOR DEBRIS EXCLUSION SYSTEM

BACKGROUND

In the hydrocarbon exploration and recovery art, communication and control become more important and prevalent each and every day. More and more sensory, monitoring and control equipment is placed in wellbores and likely will continue to enhance production capability. While it is possible to create complete strings that include all of the communication monitoring and control conduits already in place, there is increasing interest in wet connect capabilities to speed and simplify equipment changes for maintenance, replacement or simply to employ different configurations over time in the well to optimize production. While wet connect systems are relatively common in the art, there are often trade-offs among cost, functionality, reliability, etc.

Commonly, wet connects are hydraulic or electric in nature, where a pressure competent connection or an electrically isolated connection, respectively, must be created. These require a reasonably high degree of cleanliness and there are several methods currently utilized to make these connections with varying success rates.

More recently, optic fibers have become more and more the conduit of preference. As optic fibers require greater positional registration and even more cleanliness, the art is always receptive to improvement in systems designed to wet-connect such fibers.

SUMMARY

A downhole wet-connector and debris exclusion system includes a relatively stationary component; a relatively mobile component operably engageable with the relatively stationary component; at least one connector disposed behind a moveable debris exclusion member in a protected condition within the relatively mobile component; and at least one complementary connector disposed behind another movable debris exclusion member in a protected condition within the relatively stationary component each of the moveable debris exclusion members being openable to expose the at least one connectors therebehind upon axial motion of the relatively stationary component and the relatively mobile component into contact with one another.

A method for excluding debris in a connector includes orientating a relatively mobile component with a relatively stationary component; opening a physical barrier to debris for each end of a two part connector; and aligning the two part connector and axially engaging the two part connector.

BRIEF DESCRIPTION OF THE DRAWINGS

Referring now to the drawings wherein like elements are numbered alike in the several Figures.

DETAILED DESCRIPTION

Figure 1A:
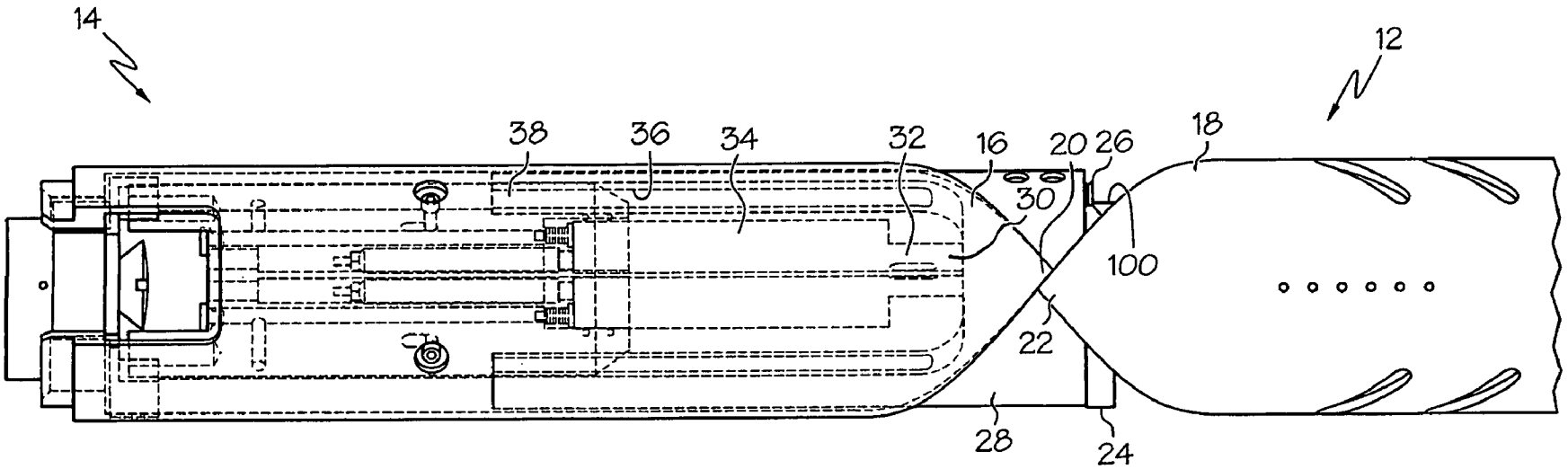
FIG. 1A is a side partially transparent view of a downhole wet-make connector debris exclusion system as disclosed herein.

Referring to FIGS. 1A-6B, a system 10 capable of promoting wet connection of an optic fiber (or other conductor) with appropriate positioning and debris exclusion is illustrated. There are two major components of system 10. These are: a relatively stationary component 12 and a relatively mobile component 14. In the discussion that follows the relatively stationary component 12 is referred to as a portion of a Packer, the rest of the components of which are not important to this disclosure and are therefore not illustrated. The relatively mobile component 14 is described as an anchor and is run from a remote location, such as a surface location, into contact with packer 12 in order to effectively wet connect and debris exclude at least one conductor (hereinafter, the conductor is called an optic fiber however it is to be understood that other conductors are also contemplated). The system 10 includes an anchor orienter such as an orientation profile 16 and a packer orienter such as an orientation profile 18, each of which is illustrated in FIG. 1A as just making contact near peaks 20 and 22 thereof. It is to be understood that the particular illustrated contact point is by way of illustration and not limitation as one of ordinary skill in the art should be aware that such profiles are designed to land in any orientation and then follow the profile to create the connection orientation that is desired in a particular application.

Also visible in FIG. 1A through transparent profile 16 are a number of other components of the anchor 14. It is noted that some of the components are exposed from the profile 16 at least in part and therefore may be seen without the benefit of the translucency of profile 16. Starting from a downhole end of anchor 14, a rotation member 24 is a mechanical debris component that is rotationally mounted upon a rotation track 26. Rotation of the rotation member 24 is automatic following landing of anchor 14 in packer 12 based upon grooves and cam followers discussed further hereunder. The rotation track 26 is an extension of a tubular alignment ring 28. The alignment ring 28 provides at least one and as illustrated two, though not necessarily limited to any particular number, tight through passages 30. The passages 30 tightly but not sealingly each receive a leg 32 of a female connector shell 34. The alignment ring 28 further provides a recessed section 36 visible in FIG. 1A but better seen in FIG. 1B. The recessed section 36 is receptive of an inner housing 38.

Referring again to FIG. 1B, the inner housing 38 has been exploded away from the rest of anchor 14 to make it easier to see. The inner housing 38 includes shell receptacles 40, receptive of female connector shells 34. Each receptacle 40 is in fluid communication with a flushing conduit 42 and a signal conductor conduit 44. It will be noted that the flushing conduit further includes an inlet 46 in fluid communication with a reservoir that is filled with flushing fluid during use of the system 10. The reservoir itself is defined by an uphole end 48 of alignment ring 28, an inside surface 50 of inner housing 38 (visible only in FIG. 1C due to rotation of the exploded view of the system), a piston housing 52 and a housing stop 54. The reservoir is not sealed in at least one embodiment, but is tight enough to hold most of the fluid therein until used.

Inner housing 38 further includes biasing bores that in one embodiment include coil springs 58 to provide a bias on inner housing 38 toward a downhole end of anchor 14. It will be appreciated that any type of biasing means could be substituted as desired, including but not limited to fluid pressure devices. Springs 58 bear against a downhole surface 60 of stop 54 and cooperate with slots 62 in piston housing 52 through fasteners 64 that are attached to the inner housing 38. The fasteners 64 extend through openings 66 in inner housing 38 to positionally limit but not to fix movement of inner housing 38 so that the inner housing is compliant. The limited movement or compliancy of the inner housing 38 allows for similar limited movement in female connector shells 34 thereby reducing a potential shock load to female connector shells 34 and the conductor therewithin or allowing tolerance stack up issues to be absorbed without detrimental effect when connection is completed with packer 12.

Figure 1B:
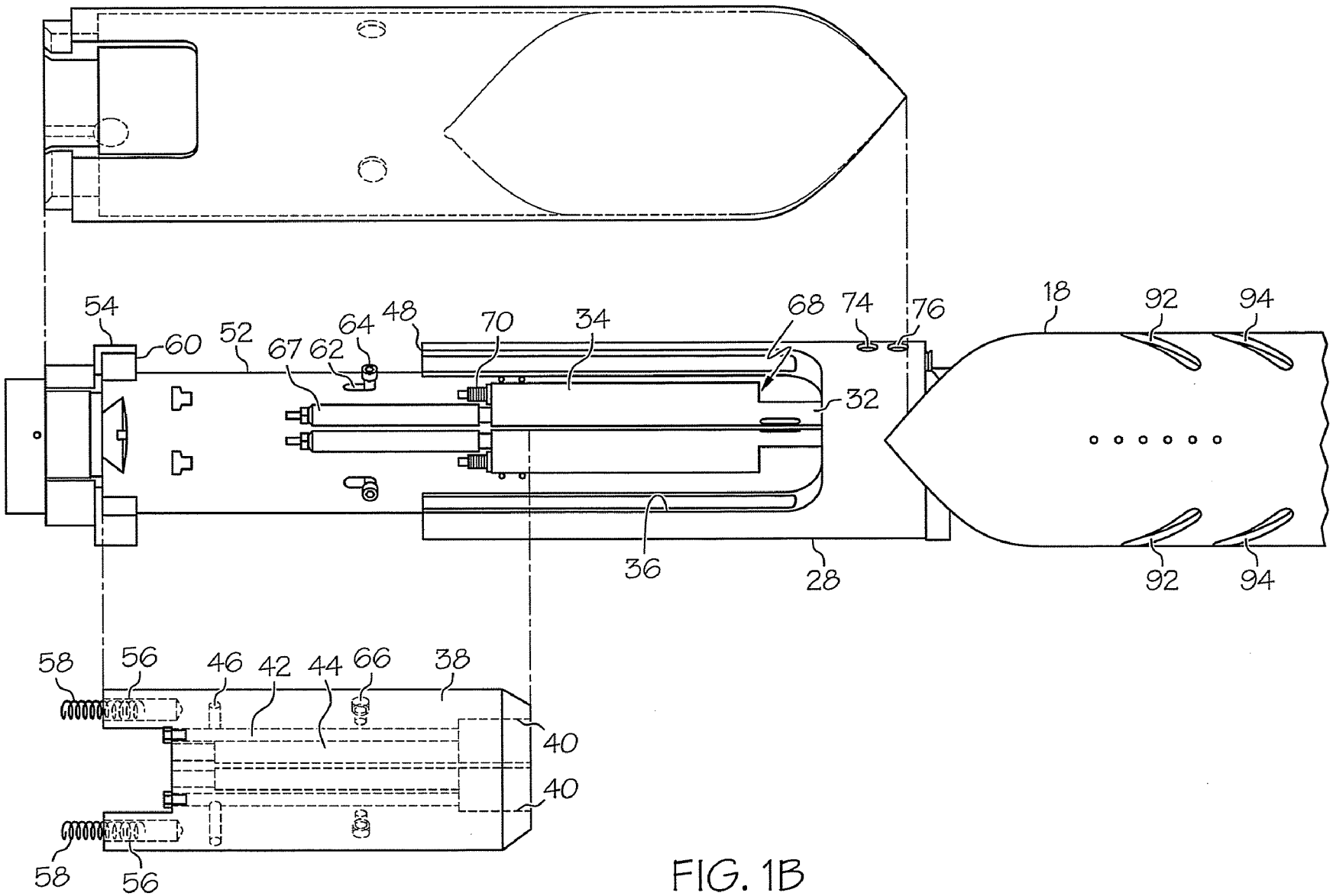
FIG. 1B is the same view as FIG. 1A, but with two of the components illustrated in FIG. 1A removed to improve visibility of underlying structures.
Figure 1C:
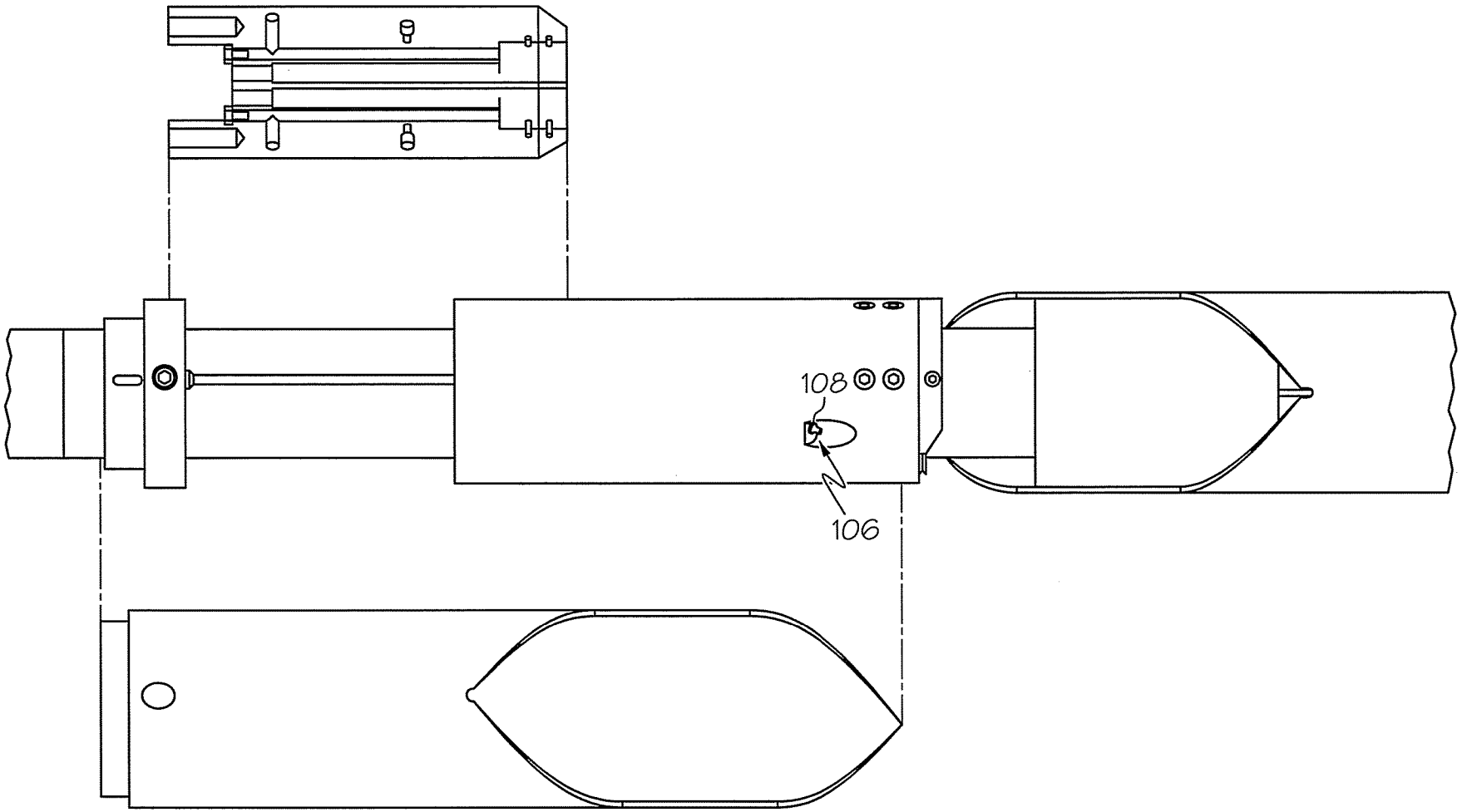
FIG. 1C is the view of FIG. 1B rotated 180° to show the opposite side thereof.
Figure 2:
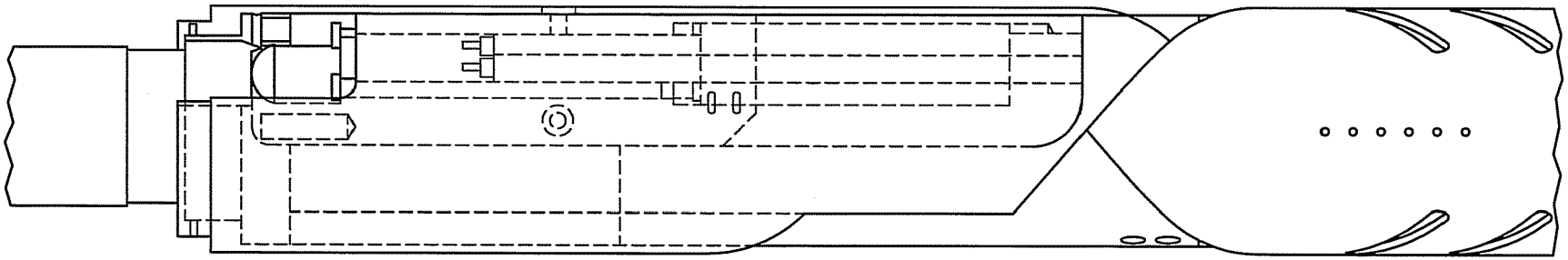
FIG. 2 is a view of the system in FIG. 1A with profiles beginning to rotate various components of the system.
Figure 3A:
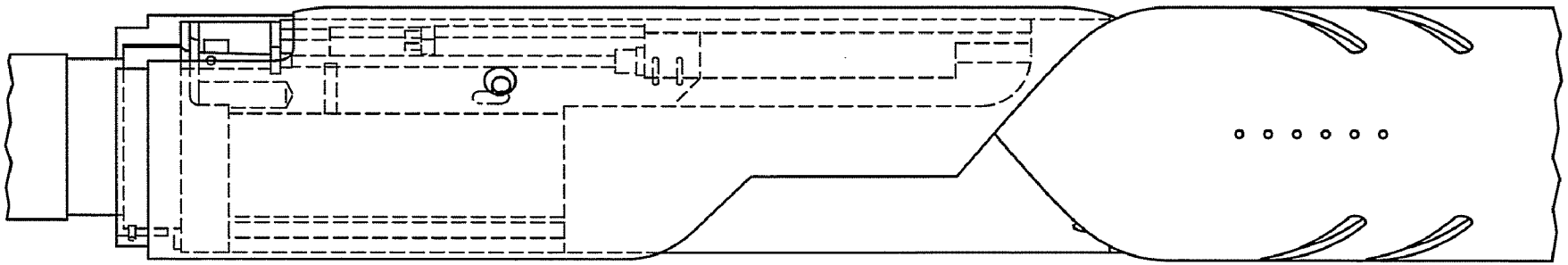
FIG. 3A is a view of the system in FIG. 2A with profiles further rotated.
Figure 3B:
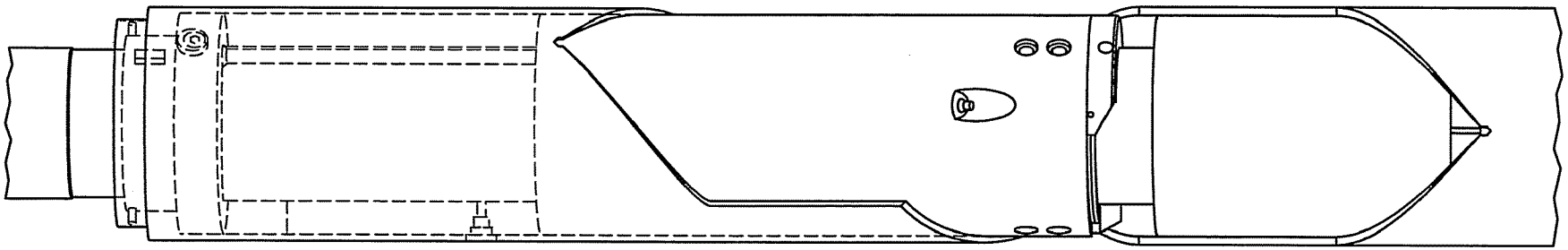
FIG. 3B is the illustration of FIG. 3A rotated 180° to show the opposite side thereof.
Figure 4:
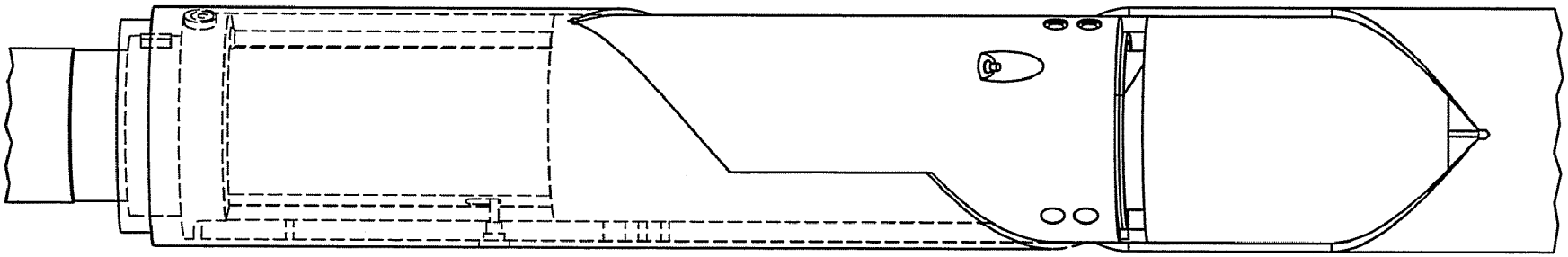
FIG. 4 illustrates the next sequential movement following the FIG. 3B view.

Still referring to FIGS. 1A and 1B, there is another fluid reservoir provided within system 10. This is not to say that the reservoirs are necessarily distinct, but that their volumes are relatively segregated from one another. Strictly speaking, the reservoirs are fluidly connected in this embodiment and therefore constitute a single volume but due to the exit configuration for the fluid, they act as independent reservoirs. The second fluid reservoir is defined by the piston housing 52, the alignment ring 28, the inner housing 38 and the profile 16. It is not necessary to seal either of the fluid reservoirs. Because the tolerances are relatively close, and although the reservoirs will be leaky, the majority of the fluid contained therein will be available, at the time its use is required, for the purpose for which it is originally installed. This will be described further hereunder in the operation section of this disclosure. It is noted that it is not necessarily inappropriate to seal portions of the fluid reservoirs providing the application of fluid to the desired location is retained. Rather, the intent of the teaching is merely to indicate that it is not necessary that these fluid chambers be sealed; relaxation of machining tolerances with respect to sealing can represent a cost savings. Finally with respect to the reservoirs, they are fillable with fluid after construction of the anchor through a port 106. The port will in some embodiments have a check valve therein and in the illustrated embodiment uses a grease fitting 108. This port 106 and the grease fitting 108 are numerically identified in FIG. 1C.

Returning to the female connector shell(s) 34, two passages require introduction. The first is first conductor passage 67 which houses a conductor from uphole and second is a central conductor channel 68. In one embodiment, these two passages are in parallel. This construction allows for a substantial benefit with respect to debris flushing relative to the connector shells discussed herein. Because of the offset nature of the passages, there is the possibility of access to the central conductor channel 68, which is where connection is made to the male counterpart in the packer 12. At a relative opposite end of shells 34 from leg 32 is illustrated a fluid transfer housing 70 that ensures reasonable interaction between the flushing conduit 42 and the central conductor channel 68 of the shell 34. This interface, consistently with the other interfaces of flushing fluid in that this system, does not require a seal. Interaction of fluid transfer housing 70 and flushing conduit 42 of inner housing 38 can be appreciated from FIG. 1A. In operation, flushing fluid is forced through the flushing conduit 42, through housing 70 and through the extent of the female connector shells 34 in the central conductor channel 68. It is important to note that the flushing fluid is not, in this instance, applied around or at the connector but actually directly through the central conductor channel 68 thereof. This is the very channel that the male side of the conductor connector penetrates upon connection. Thus, with this system, superior cleaning and the greatest reliability of debris exclusion is achieved by flushing the connector directly through its middle.

The female connector shells are configured to ensure a signal propagating optical connection between two optical fiber members not previously connected to one another. The details of how this is done are not included in this disclosure because they are the subject of U.S. Pat. No. 5,838,857, the entirety of which is incorporated herein by reference.

Figure 5:
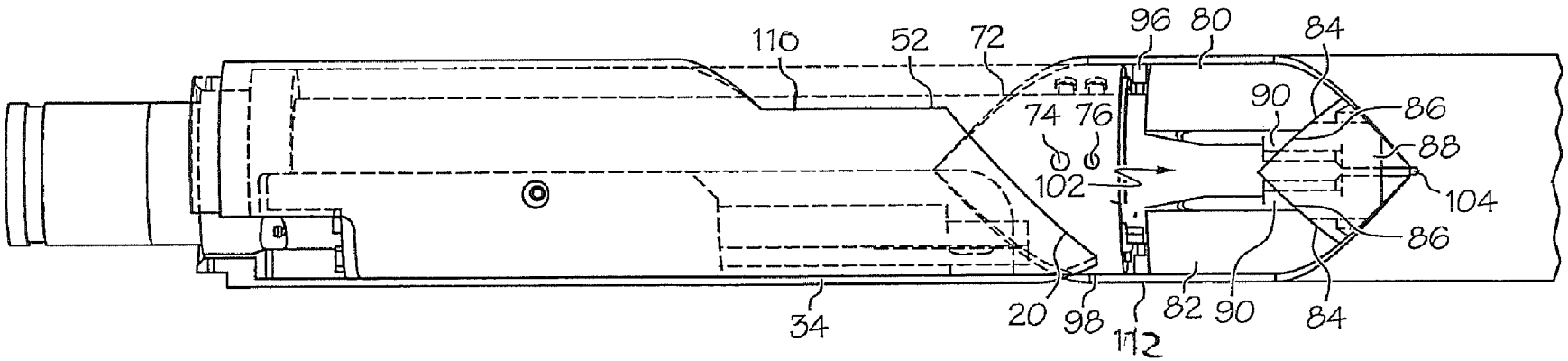
FIG. 5 is a next sequential movement view after FIG. 4.

In order to introduce the final components of the anchor 14, reference to FIG. 5 is made wherein the piston housing 52 can be seen to include a groove 72 by which the rotation member 24 is rotated during translation of alignment ring 28 along piston housing 52. Further, in FIG. 5 as well as in FIG. 1B and FIG. 1C, a cam fastener 74 and a release fastener 76 are visible. The release fastener 76 in this embodiment is a shear screw, but it is to be appreciated that any hold and release device could be substituted for. The purpose of fastener 76 is to prevent premature motion of alignment ring 28 relative to piston housing 52. More specifically, alignment ring 28 should only move relative to piston housing 52 upon landing of anchor 14 in packer 12. The actual load of the landing is imparted through rotation member 24 into alignment ring 28. Once the shear fastener 76 or other release member has released the alignment ring 28 from the piston housing 52, continued downward motion of piston housing 52 will cause rotation member 24 to rotate due to the ring tracking the groove 72 (illustrated in FIG. 5). While this is occurring, the alignment ring 28 is held in alignment relative to piston housing 52 by cam fastener 74 in an axial groove of the piston housing 52 not visible these drawings. The rotation of rotation member 24 has for its purpose, to open the passages 30 at the downhole end of legs 32 of female connector shells 34. As noted above, the rotation member 24 is a mechanical debris excluder and must be removed prior to connection of the optic fiber conduit at female connector shell(s) 34.

Again, with reference to FIG. 5, it is considered useful to introduce the components of the packer 12 that are important to operation of the invention. Operation will be discussed hereunder. Within the packer 12 there are two doors, one being identified by numeral 80 and the other being identified by numeral 82. In the FIG. 5 position of the system 10, the doors are already partially opened. It will be noted that each door includes an angled downhole surface 84 that rides upon an uphole angled surface 86 of a connector guard 88. The connector guard 88 mounts and protects at least one male connector shell 90 (as illustrated two, and as in the female connector, shells any number is possible). The male connector shell(s) 90 are thus maintained in an appropriate position laterally with respect to each other and longitudinally with respect to the female connector shells 34. Referring again to the doors 80 and 82, it is important to note that these slidingly move on an inside dimension of profile 18 within helical grooves 92 and 94. In order to interact with grooves 92 and 94, each door 80 or 82 is provided with a cam profile (not shown) that may be a fastener or maybe a molded or machined component.

Having introduced all of the operative components of system 10, the operation of the device can now be described. Several of the drawing figures in the subject application are sequential views of the device in operation; these are FIGS. 1A, 2, 3A, 4, 5, and 6B. It will be noted by the astute reader that at FIG. 4 through the end of the listed sequence, the tool is illustrated 180° rotated relative to the sequenced drawings occurring before FIG. 4. This treatment provides the best understanding of the system 10 without unnecessarily duplicative views.

Beginning at FIG. 1A, it will be appreciated that the anchor portion 14 has been tripped in the hole and has come into contact with packer 12. The bottom portion 100 of piston housing 52 can be seen at the interface of anchor 14 in packer 12, that portion 100 extending into an inside dimension of packer 12. The portion 100 is not intended to contact doors 80 and 82 but rather to slide into packer 12 at an interior aspect of the doors. As portion 100 continues to enter packer 12, peaks 20 and 22 find a position along profiles 16 and 18 and begin to orientate anchor 14 relative to packer 12. While this is occurring, rotation member 24 comes into contact with doors 80 and 82 at surfaces 96 and 98, respectively. This is a loaded contact that will push the doors open and at a preselected load will shear or otherwise release fastener 76 allowing alignment ring 28 to translate relative to piston housing 52. This translation causes rotation member 24 to rotate due to groove 72 of piston housing 52 moving therepast in a direction toward packer 12, thereby removing the mechanical impediment to access to passages 30. At the same time, alignment ring 28 is moving toward stop 54 underneath the relatively stationary inner housing 38. This causes both of the fluid reservoirs within anchor 14 to be volumetrically reduced in size. Since the fluid within the reservoirs is relatively incompressible, it must, of course, escape during volumetric change of the reservoirs. Some of the fluid is cause to run through flushing conduit 42, which is delivered through female connector shell 34 directly through the center of the connection. This virtually guarantees that no debris will be in the connector central opening. Moreover, fluid from the reservoir that is substantially defined by the recessed section 36, is exhausted mostly through passages 30 thereby flooding a connection area 102 best viewed in FIG. 5. The flushing fluid, which may be a hydraulic oil or in other embodiments may be a different fluid. Moreover, it is contemplated that the fluid may be a viscosity adjustable fluid to allow for tailoring of the properties of the fluid for particular applications. In one embodiment the fluid is a hydroxyethylcellulose (HEC) gel that is commercially available from many sources. The fluid flushes away any debris that might have landed on any of the connection portions of this system 10 during the orientation thereof and during the opening of the mechanical exclusion barriers of the rotation member 24 and the doors 80 and 82. Further, the flushing fluid will create a temporary bubble of clean fluid around the connection site for the final connection movement. In addition, and particularly in connection with an adjustable viscosity fluid, an added benefit can be achieved by adjusting the viscosity to provide both flushing of debris but also to provide a cushion for the connectors. The gel with enough viscosity to hold together will slow the connectors during connection and allow for a gentle engagement. In essence, the gel is used somewhat like a shock absorber. And as an added benefit, if HEC is utilized, there is no environmental impact as the material is environmentally benign.

Figure 6A:
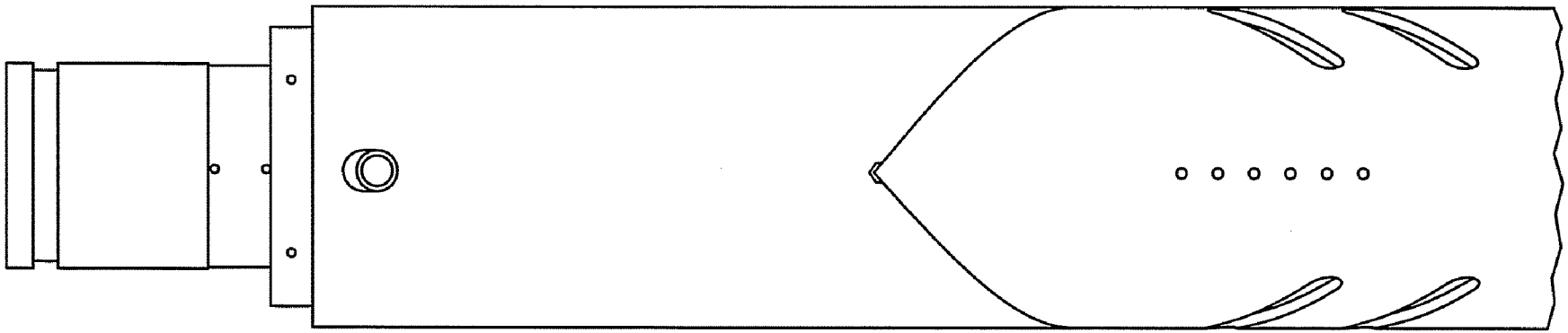
FIG. 6A illustrates one side of the debris exclusion system fully connected.
Figure 6B:
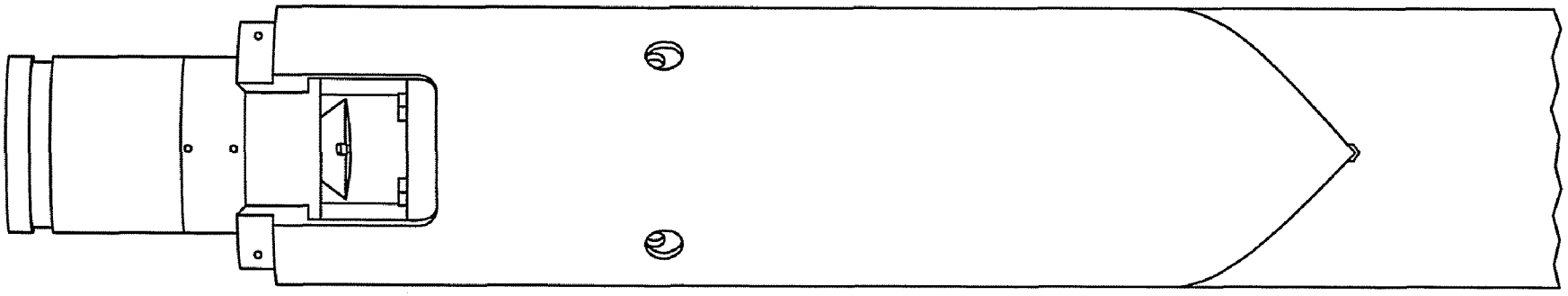
FIG. 6B illustrates an opposite side of the debris exclusion system from that illustrated in FIG. 6A.

Simultaneously to the pressurization of the fluid reservoirs within the anchor 14, doors 80 and 82 are being pushed open by an axial load applied through the rotation member 24 and the alignment ring 28. In FIG. 5, the doors 80 and 82 are illustrated in the partly opened position, whereas in the fully open position, they would be further rotated away from male connector shells 90. Also visible in the FIG. 5 view, is peak 20 almost aligned with a profile vee 104 of profile 18. In FIG. 6B, peak 20 is shown in contact with profile vee 104 of system 10, which is its completely connected position. Referring back to FIG. 5 again, it is noted that female connector shells 34 are still not aligned with male connector shells 90, but are close to being aligned. Following the FIG. 5 view, it will be apparent to the reader having been exposed to the foregoing, that anchor 14 will continue to rotate relative to packer 12 thereby aligning female connector shells 34 with male connector shells 90. Once rotational alignment is complete, it will be appreciated that a profile flat 110 and a profile flat 112 on anchor 14 and packer 12, respectively, will allow a direct axial motion to ensue thereby causing female connector shells 34 to engage male connector shells 90 and at the same time allow profiles 16 and 18 to seat fully with one another with us circumferentially closing and protecting the connection area. It will be appreciated also then, that the helix angle of profile 16 and profile 18 is important to the successful connection of system 10. These profiles must be timed accurately to align all components of system 10 in order to assure that a signal connection is achieved and that a mechanical connection is complete.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole wet-connector and debris exclusion system for a signal capable connection comprising:

a relatively stationary component;

a relatively mobile component operably engageable with the relatively stationary component;

at least one signal capable connector disposed behind a moveable debris exclusion member in a protected condition within the relatively mobile component;

at least one complementary signal capable connector in a protected condition disposed behind a helically movable debris exclusion member within the relatively stationary component the helical movement of the debris exclusion member being relative to the relatively stationary component, the moveable debris exclusion member being openable to expose the at least one complementary signal capable connector therebehind and enable signal capable connection between the at least one signal capable connector and the at least one complementary signal capable connector upon axial motion of the relatively stationary component and the relatively mobile component into contact with one another.

2. The downhole wet-connector and debris exclusion system for a signal capable connection as claimed in claim 1 wherein the relatively stationary component further includes an orienter having a profile flat.

3. The downhole wet-connector and debris exclusion system for a signal capable connection as claimed in claim 1 wherein the relatively mobile component further includes an orienter having a profile flat.

4. The downhole wet-connector and debris exclusion system for a signal capable connection as claimed in claim 1 wherein the relatively stationary component further includes a orienter and the relatively mobile component further includes a complementary orienter to the relatively stationary component orienter each orienter having a profile flat facilitating directly axial motion and connector engagement.

5. The downhole wet-connector and debris exclusion system for a signal capable connection as claimed in claim 4 wherein the orienter and the complementary orienter are profiles.

6. The downhole wet-connector and debris exclusion system for a signal capable connection as claimed in claim 5 wherein the profiles are timed to align the at least one connector and the at least one complementary connector prior to an axial motion to connect the at least one connector and the at least one complementary connector.

7. The downhole wet-connector and debris exclusion system for a signal capable connection as claimed in claim 1 wherein the moveable debris exclusion member is a rotation member.

8. The downhole wet-connector and debris exclusion system for a signal capable connection as claimed in claim 7 wherein the rotation member is rotated by a groove in a piston housing axially translatable relative to the rotation member.

9. The downhole wet-connector and debris exclusion system for a signal capable connection as claimed in claim 7 wherein the rotation member is of horseshoe shape.

10. The downhole wet-connector and debris exclusion system for a signal capable connection as claimed in claim 7 wherein the rotation member physically blocks access to a passageway in an alignment ring rotationally attached to the rotation member and opens access to the passageway when rotated.

11. The downhole wet-connector and debris exclusion system for a signal capable connection as claimed in claim 1 wherein the helically moveable debris exclusion member is at least one door helically mobile upon application of axial load thereto.

12. The downhole wet-connector and debris exclusion system for a signal capable connection as claimed in claim 11 wherein the at least one door is two doors that are mobile in opposing circumferential directions.

13. The downhole wet-connector and debris exclusion system for a signal capable connection as claimed in claim 11 wherein the at least one door includes a release member.

14. The downhole wet-connector and debris exclusion system for a signal capable connection as claimed in claim 1 wherein the system includes at least one flushing fluid reservoir whose volume is diminishable upon application of axially directed load on the system and whose fluid contents are expelled at a connection site of the system.

15. The downhole wet-connector and debris exclusion system for a signal capable connection as claimed in claim 14 wherein the at least one flushing fluid is expelled directly out of a connection receptacle of the at least one connector.

16. The downhole wet-connector and debris exclusion system for a signal capable connection as claimed in claim 14 wherein the at least one flushing fluid is expelled about a periphery of the at least one connector.

17. The downhole wet-connector and debris exclusion system for a signal capable connection as claimed in claim 14 wherein the flushing fluid is a viscosity adjustable fluid.

18. The downhole wet-connector and debris exclusion system for a signal capable connection as claimed in claim 17 wherein the viscosity adjustable fluid is a hydroxyethylcellulose gel.

19. The downhole wet-connector and debris exclusion system for a signal capable connection as claimed in claim 17 wherein the viscosity adjustable fluid acts as a shock absorber for the system.

20. The downhole wet-connector and debris exclusion system for a signal capable connection as claimed in claim 1 wherein the at least one connector is compliantly mounted in the relatively mobile component.

21. The downhole wet-connector and debris exclusion system for a signal capable connection as claimed in claim 1 wherein the at least one connector further includes a first conductor passage; and a second conductor passage receptive to a complementary connector having a conductor at one end and fluidly connectable to a flushing fluid source at an opposite end thereof, the second conductor passage configured to facilitate conductive connection between the first conductor passage and the complementary connector conductor, the flushing fluid being flushable directly through the second conductor passage.

22. The downhole wet-connector and debris exclusion system for a signal capable connection as claimed in claim 21 wherein the at least one connector includes a fluid transfer housing capable of coupling the connector to a fluid source.

23. The downhole wet-connector and debris exclusion system for a signal capable connection as claimed in claim 21 wherein the at least one connector is a fiber optic connector.

24. A method for excluding debris in a signal capable connector comprising:

orientating a relatively mobile component with a relatively stationary component;

helically opening a physical barrier to debris, the barrier to debris being disposed in one of the relatively mobile component or the relatively stationary component, the helical movement of the barrier to debris being relative to the one of the relatively mobile component or the relatively stationary component within which the barrier to debris is disposed; and aligning the two part connector and axially engaging the two part connector.

25. The method as claimed in claim 24 wherein the method further comprises flushing a flushing fluid directly through at least one end of the two-part connector.

26. The method as claimed in claim 24 further including flushing a flushing fluid around a connection site of the two-part connector.

27. The method as claimed in claim 24 further includes adjusting a viscosity of a flushing fluid and flushing the adjusted viscosity fluid at a connection site.

28. The method as claimed in claim 24 wherein the opening further includes loading the physical barrier to release a release member.

29. The method as claimed in claim 24 wherein the method includes timing the orientating to ensure axial alignment of the two-part connector.

30. The method as claimed in claim 24 wherein the engaging of the two-part connector is compliant.

* * * * *